United States Patent [19]

Kline

[11] 4,110,852

[45] Sep. 5, 1978

[54] POOL STRUCTURE

[76] Inventor: Dennis D. Kline, 2148 W. Wood Dr., Phoenix, Ariz. 85029

[21] Appl. No.: 846,413

[22] Filed: Oct. 28, 1977

[51] Int. Cl.[2] ..... E04H 3/16; E04H 3/18

[52] U.S. Cl. ..... 4/172; 4/172.15; 4/172.17

[58] Field of Search ..... 4/172, 172.19, 172.17, 4/172.15, 172.18, 172.21, 178, 181, 180

[56] References Cited

U.S. PATENT DOCUMENTS

| | | | |
|---|---|---|---|
| 3,623,165 | 11/1971 | Whittell, Jr. | 4/172.15 |
| 3,693,194 | 9/1972 | Schindler et al. | 4/172.17 |
| 3,781,925 | 1/1974 | Curtis et al. | 4/172.15 |
| 3,829,911 | 8/1974 | Bishop | 4/172.17 |
| 3,908,205 | 9/1975 | Chase | 4/172 |
| 3,940,807 | 3/1976 | Baker et al. | 4/172 |
| 3,943,580 | 3/1976 | Carter | 4/172.15 |
| 3,952,338 | 4/1976 | Troxclair | 4/172.19 |
| 4,001,899 | 1/1977 | Mathis | 4/172 |
| 4,019,210 | 4/1977 | Patterson et al. | 4/172 |

*Primary Examiner*—Henry K. Artis

*Attorney, Agent, or Firm*—Herbert E. Haynes, Jr.

[57] ABSTRACT

A one piece molded pool structure configured to define a pool compartment having a seat formed therein below the water line and having an equipment compartment for housing water circulation and flow control equipment. Water from the pool compartment moves through the circulation equipment and by selective positioning of the flow control equipment, is returned under pressure to the pool compartment either through a first hydro-jet distribution manifold located below the water line or through a second hydro-jet distribution manifold located above the water line. A waterfall superstructure may be formed on the pool which allows the water from the circulation equipment to be optionally returned to the pool compartment through a waterfall manifold located in the upper end thereof.

8 Claims, 4 Drawing Figures

POOL STRUCTURE

BACKGROUND OF THE INVENTION

1. Field of the Invention

This invention relates to pool structures and more particularly to a self-contained above ground pool structure having plural optionally selective water circulation systems.

2. Description of the Prior Art

In general, pools of the therapeutic or relaxation type are relatively small structures which are provided with various devices for relaxation of bathers. In some instances, the water is heated, in other instances the water is aerated, in other instances the water is simply agitated, and in the more complex structures it can be any combination of the above. However, such pools have received only limited public acceptance due to such factors as cost, installation complexity, limited capabilities and the like.

For example, one specific prior art structure is disclosed in U.S. Pat. No. 3,693,194 as including a therapeutic pool for inground installation. This prior art pool is provided with means for mixing air from an external source with water from an external source and supplying that aerated water to the pool through a plurality of jets disposed about the periphery of the pool, with the jets located above the seats provided in the pool. Inground installations of this type are inherently expensive due to excavation costs, underground plumbing and drainage systems, the need for remote positioning of pumps, filters and similar associated equipment. In addition to the above described installation costs and complexities, this prior art pool is a permanent installation, in that it cannot readily be moved to suit the desires of the owner, and is of limited usage in that only a single operational mode is provided.

It is therefore desirable to provide a new and useful pool of the therapeutic or relaxation type which overcomes some of the shortcomings and drawbacks of the prior art.

SUMMARY OF THE INVENTION

In accordance with the present invention, a new and improved pool of the therapeutic or relaxation type is disclosed. The pool is a self-contained above ground structure of one piece molded construction which is configured to define a pool compartment and an equipment compartment. The equipment compartment contains water circulation equipment, such as a pump and filter, and may, if desired, house aeration mechanisms. Also, the equipment compartment contains flow control mechanisms by which water drawn from the pool, by the circulation equipment, may be selectively returned to the pool compartment either through a first hydro-jet distribution manifold located below the water line, or through a second hydrojet distribution manifold located above the water line.

A waterfall superstructure may be formed on the pool which allows circulating water to be optionally returned to the pool through a waterfall distribution manifold provided adjacent the top of the superstructure.

Accordingly, it is an object of the present invention to provide a new and improved pool structure of the therapeutic or relaxation type.

Another object of the present invention is to provide a new and improved therapeutic or relaxation type of pool which is a self-contained above ground structure.

Another object of the present invention is to provide a new and improved pool structure of the above described character which is provided with plural optionally selective water circulation systems.

Another object of the present invention is to provide a new and useful pool of the above described type which is a molded one piece structure configured to provide a pool compartment and an equipment compartment.

Another object of the present invention is to provide a new and useful pool of the above described character in which the equipment compartment contains water circulation equipment and flow control equipment.

Still another object of the present invention is to provide a new and improved pool structure of the above described character which is provided with a first hydro-jet water distribution manifold for optionally returning water to the pool compartment below the water line therein, and a second hydro-jet water distribution manifold for optionally returning water to the pool above the water line.

Yet another object of the present invention is to provide a new and improved pool structure of the above described character which may include a waterfall superstructure for optionally returning water to the pool compartment through a waterfall distribution manifold provided in the superstructure.

The foregoing and other objects of the present invention, as well as the invention itself, may be more fully understood from the following description when read in conjunction with the accompanying drawings.

DESCRIPTION OF THE PREFERRED EMBODIMENT

Figure 1:
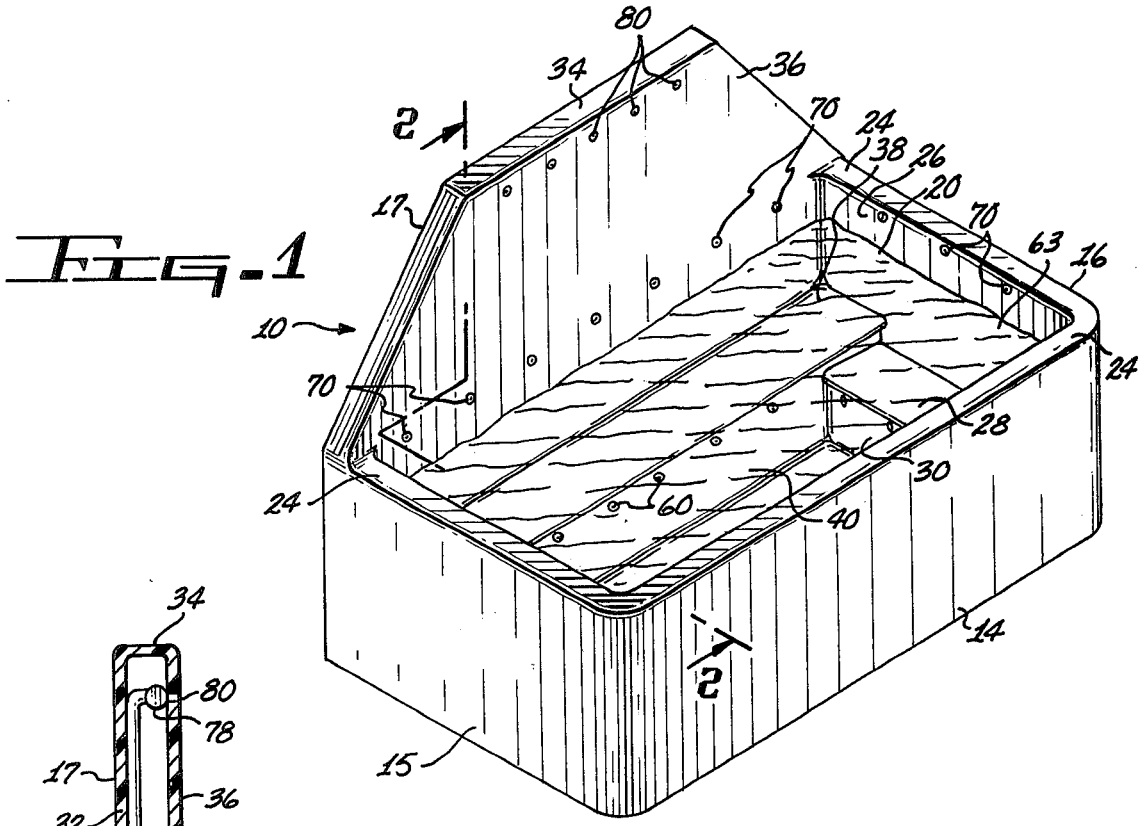
FIG. 1 is an isometric view of the pool structure of the present invention.

Referring more particularly to the drawings, FIG. 1 illustrates the pool structure of the present invention which is indicated in its entirety by the reference numeral 10.

The pool structure 10 is in the form of a tub-like upwardly opening enclosure of substantially rectangular configuration which is preferrably a rigid one piece structure formed such as by well known fiberglass molding and fabrication techniques.

The pool structure 10 comprises a bottom wall 13, a double panel front wall 14, a pair of opposed double panel side walls 15 and 16, and a double panel rear wall 17, all of which are integral and define an upwardly opening pool compartment 20.

The front and side walls 14, 15 and 16, respectively, are similarly configured in that each are provided with an upstanding exterior panel 22 which is directed inwardly at its uppermost end to form a rim 24 and is directed downwardly at the innermost limit of the rim 24 to provide a liner panel 26. The liner panels 26 each depend from the rim 24 and are curved inwardly to form seat portions 28 and are curved downwardly from the innermost ends of the seats 28 to provide seat risers 30 which have their lowermost edges integral with the bottom wall 13 of the pool structure.

The double panelled rear wall 17, in the preferred embodiment as will hereinafter be described in detail, extends normally from the bottom wall 13 a distance considerably above the front and side walls 14, 15 and 16. However, the rear wall 17 is similarly configured in that it comprises an upstanding exterior panel 32 which is directed inwardly at its uppermost end to form a rim 34 and is directed downwardly from the innermost limit of the rim 34 to provide an integral liner panel 36. If desired, the rim 34 may be irregular in shape such as the configuration shown which includes a horizontally disposed segment flanked by sloping segments. In any event, the liner panel 36 depends from the rim 34 and is curved inwardly to form a seat portion 38 and is curved downwardly from the forwardmost end of the seat 38 to provide a seat riser 40 which has its lowermost edge integral with the bottom wall 13 of the pool structure 10.

It may now be seen that the integral double wall construction described above provides an equipment compartment 42 which is enclosed between the exterior and liner panels which form the front, side and rear walls of the pool structure 10. The equipment compartment 42 may be described as being endless in that it completely surrounds the pool compartment 20, and is quite large particularly in the areas thereof which are disposed below the seats 28 and 38 formed by the liner panels 26 and 36. It will be noted that the seat portion 38 formed by the liner panel 36 of the rear wall 17 is disposed somewhat above the plane of the seats 28 formed by the front and side walls 14, 15 and 16. This upwardly spaced positioning of the seat 38 provides the equipment compartment 42 with an enlarged area below that seat in which water circulation and flow control equipment are preferrably located as will now be described.

Figure 2:
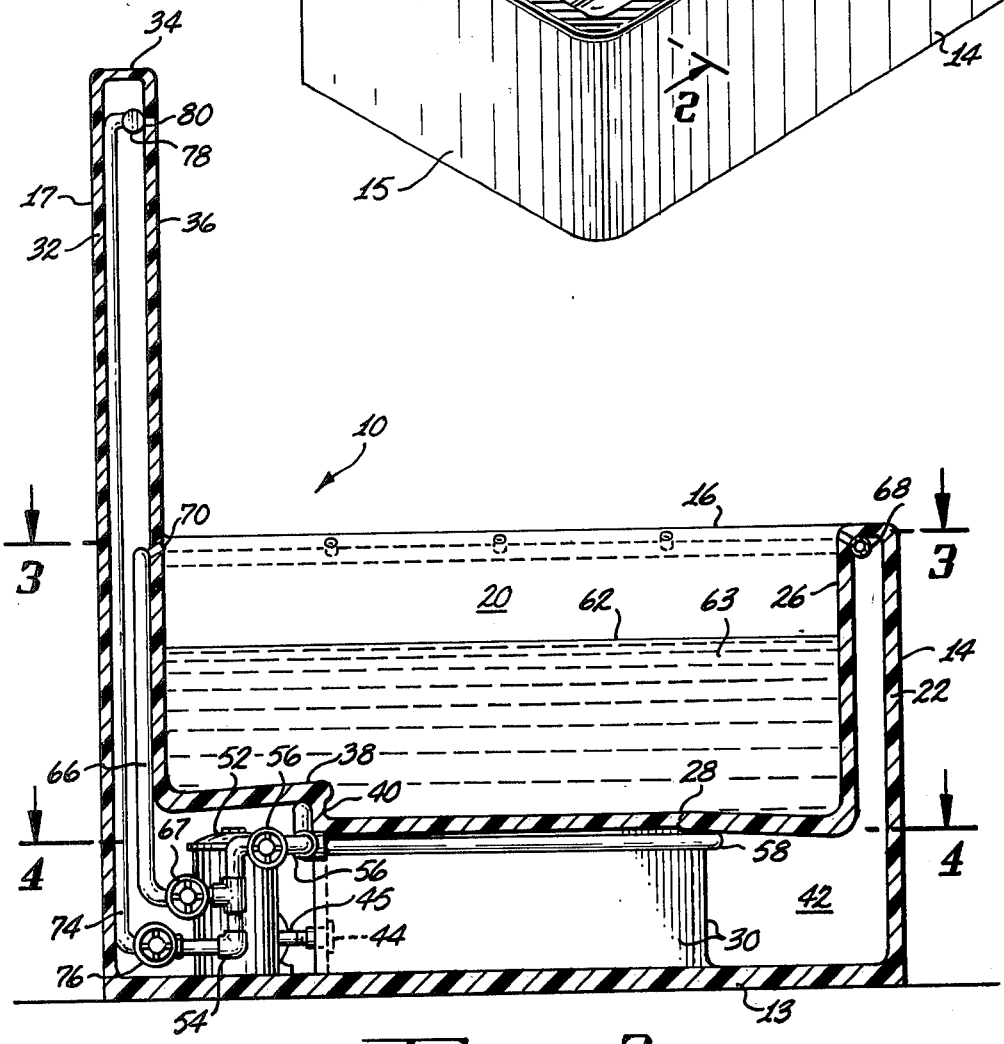
FIG. 2 is an enlarged sectional view taken along the line 2—2 of FIG. 1.
Figure 3:
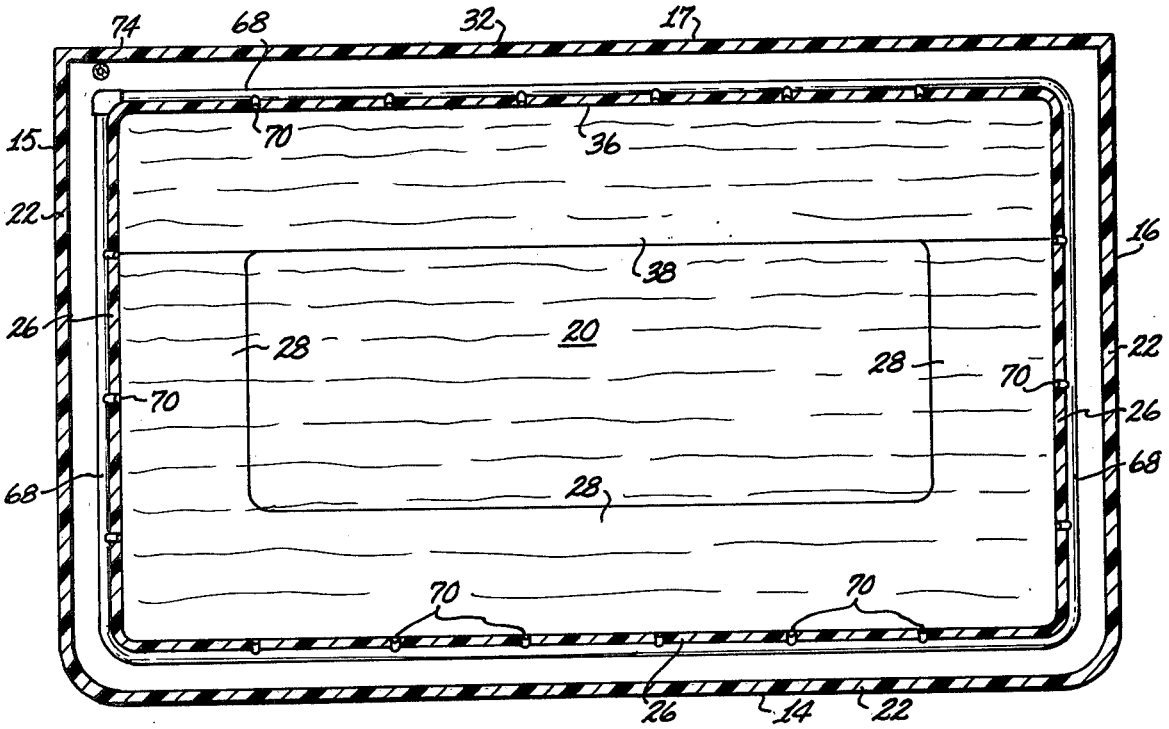
FIG. 3 is a sectional view taken along the line 3—3 of FIG. 2.
Figure 4:
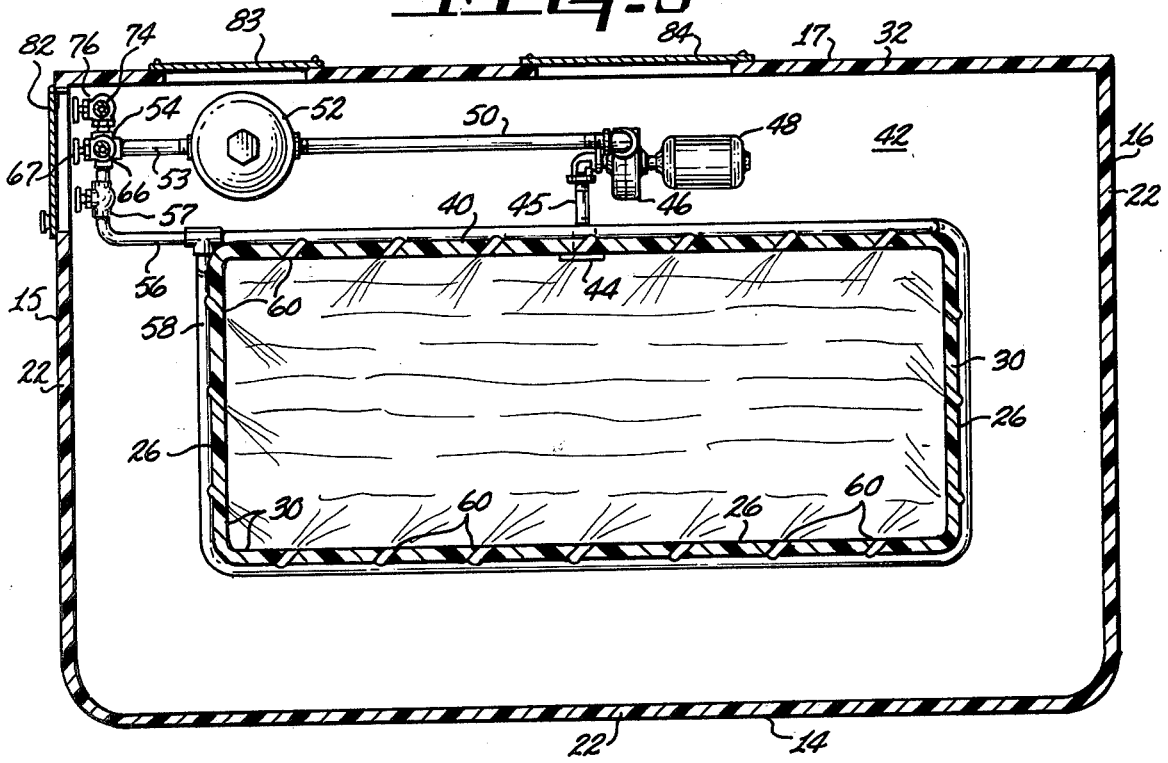
FIG. 4 is a sectional view taken along the line 4—4 of FIG. 2.

As shown in FIGS. 2 and 4, a water outlet drain 44 is suitably mounted in the seat riser segment 40 of the rear wall liner panel 36 adjacent the lowermost edge thereof. The drain 44 communicates by means of a pipe 45 with the inlet to a suitable pump 46 which is driven by an electric motor 48. A pipe 50 extends between the outlet of the pump 46 and the inlet of the suitable filter 52. Another pipe 53 connects the outlet of the filter 52 with a header 54.

The pump 46, electric motor 48, and filter 52 may all be commercially available items which will vary in size, configuration, operation and the like. For example, although not shown, the filter 52 will be appropriately provided with suitably located plumbing, control valves, and the other equipment necessary to accomplish backwashing of the filter as is well known in the art.

When operating, the pump 46 and filter 52 cooperate to draw water from the pool compartment 20 and deliver that water under pressure in a filtered condition to the header 54.

The header 54 is provided with a first branch pipeline 56 having a shutoff valve 57 therein, with the branch pipeline 56 coupled to a first endless hydro-jet water distribution manifold 58. The first hydro-jet manifold 58 is a closed loop pipeline which is mounted immediately below the seats 28 and 38 on the surfaces of the seat risers which face into the equipment compartment 42. The manifold 58 is provided with a plurality of nozzles 60 disposed in substantially equally spaced increments therealong, and which extend angularly therefrom through the seat risers 30 and 40 and terminate flush with the surfaces thereof which face into the pool compartment 20. When the shutoff valve 57 is open, filtered water under pressure from the header 54 will enter the first hydro-jet distribution manifold and will exit therefrom through the nozzles 60. Since the nozzles 60 are disposed below the water line 62 (FIG. 2) and angularly extend through the seat risers 30 and 40, the water emitted from the nozzles 60 will cause agitation of the water body 63 within the compartment 20 and will cause a generally counterclockwise swirling of the water body.

The header pipe 54 is provided with a second branch pipeline 66 having a shutoff valve 57 therein with that second branch pipeline 66 communicating with a second endless hydro-jet water distribution manifold 68. The second manifold 68 is a closed loop pipe which is mounted immediately below the rim 24 of the front and side walls 14 15 and 16, respectively, and is disposed intermediate the rim 34 and lower edge of the rear wall 17. The manifold 68 is provided with a plurality of nozzles 70 disposed in substantially equally spaced increments therealong and which extend angularly upwardly and inwardly therefrom through the liner panels 26 and 36 and terminate flush with the exterior surfaces thereof. When the shutoff valve 57 is open, filtered water under pressure from the header 54 is supplied to the second hydro-jet water distribution manifold 68 and will exit from that manifold through the nozzles 70. Since the nozzles 70 are located above the water line 62 and extend angularly upwardly and inwardly from the second manifold 68, the water emitted from those nozzles will form a shower like spray.

The header 54 may also be provided with a third branch pipeline 74, having a shutoff valve 76 therein, and which extends upwardly from the header 54 within the double panelled rear wall 17 of the pool structure 10 and communicates with a cross pipe water distribution manifold 78. The cross pipe manifold 78 is located adjacent the upper end of the rear wall 17 and is provided with a plurality of nozzles 80 disposed in substantially equally spaced increments therealong, and which extend radially from the manifold 78 through the liner panel 36 and terminate flush with the exterior surface thereof. When the shutoff valve 76 is fully opened, filtered water under pressure from the header 54 is supplied to the cross pipe manifold 78 and will exit therefrom through the nozzles 80 in the form of a shower like spray, and by partial closing of the shutoff valve 76, water from those nozzles will trickle in waterfall fashion down the exterior surface of the liner panel 36. As previously mentioned, the rear wall 17 extends considerably above the front and side walls 14, 15 and 16, respectively, and, in accordance with one of the above described operating modes, may be considered as forming a waterfall superstructure on the pool 10.

It will be understood that the water distribution manifolds 58, 68 and 78 are suitably affixed in their respective positions, with such affixation being preferrably accomplished by forming those manifolds of plastic pipe and cementing them in the proper locations in accordance with techniques well known in the art.

As shown in FIG. 4, the pool structure 10 is provided with suitable removable panels 82, 83 and 84 to provide access to the water circulating equipment and flow control mechanisms located within the equipment compartment 42.

It will be noted that the pool structure 10 is not equipped with any means for filling or draining thereof, as those items are preferrably intentionally omitted to keep manufacturing costs at a minimum and to keep installation as simple as possible. It is contemplated that the pool structure 10 can be filled with a garden hose (not shown) which can also be used to provide makeup water to replace that lost by evaporation, splashing and the like. Draining of the pool 10 can be accomplished by employing a simple siphoning technique, by utilizing a portable pump (not shown), or providing the apparatus 10 with a valve controlled outlet (not shown) to allow utilization of the pump 46.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles.

For example, it would be obvious to modify the previously described water circulation equipment by providing suitable plumging (not shown) which directs the water from the pump 46 through a remote water heater (not shown). It would further be obvious that air under pressure could be introduced into, for example, the header 54, to aerate the circulating water.

The appended claims are intended therefore to cover and embrace any such modifications within the limits only of the true spirit and scope of the invention.

What I claim is:

1. A pool structure comprising:

(a) an enclosure including a bottom wall and an integral upstanding endless wall configured to define an upwardly opening pool compartment for containing water, said upstanding endless wall being of spaced double panel construction to provide an equipment compartment therein which endlessly surrounds said pool compartment;

(b) a first hydro-jet water distribution manifold within said equipment compartment and having a plurality of nozzles extending therefrom into said pool compartment below the water line thereof;

(c) a second hydro-jet water distribution manifold within said equipment compartment and having a plurality of nozzles extending therefrom into said pool compartment above the water line thereof;

(d) a header mounted in said equipment compartment and coupled to said first and said second hydro-jet water distribution manifolds;

(e) means within said equipment compartment and coupled between said pool compartment and said header for drawing water from said pool compartment and supplying that water under pressure to said header; and (f) means connected to said header and to said first and said second hydro-jet water distribution manifolds for selectively supplying water under pressure from said header to said first and said second hydro-jet water distribution manifolds.

2. A pool structure as claimed in claim 1 wherein said enclosure comprises:

(a) a double panel front wall upstanding from said bottom wall;

(b) an opposed pair of double panel side walls upstanding from said bottom wall and integral with said front wall;

(c) a double panel rear wall upstanding from said bottom wall and integral with said pair of side walls; and (d) each of said front, side and rear walls including, I. an exterior panel, II. a rim extending inwardly from the uppermost edge of said exterior panel and integral therewith, and III. a liner panel integrally depending from the innermost edge of said rim.

3. A pool structure as claimed in claim 2 wherein said liner panel of each of said front side and rear walls is curved inwardly intermediate its upper and lower edges to form a seat portion and is curved downwardly from the extending edge of said seat portion to form a seat riser portion.

4. A pool structure as claimed in claim 1 wherein said first hydro-jet water distribution manifold comprises:

(a) a closed loop pipe disposed in said equipment compartment so as to surround said pool compartment; and (b) said plurality of nozzles disposed in substantially evenly spaced increments on said closed loop pipe and extending angularly therefrom into said pool compartment so that when a body of water is in said pool compartment and water under pressure from said header is being supplied to said first hydro-jet water distribution manifold, the water under pressure will exit from said nozzles and cause a swirling agitation of the water body in said pool compartment.

5. A pool structure as claimed in claim 1 wherein said second hydro-jet water distribution manifold comprises:

(a) a closed loop pipe disposed in said equipment compartment so as to surround said pool compartment adjacent the top thereof; and (b) said plurality of nozzles disposed in substantially evenly spaced increments on said closed loop pipe and extending angularly and upwardly therefrom into said pool compartment so that when water under pressure from said header is being supplied to said second hydro-jet water distribution manifold that water will exit from said nozzles in a shower like spray.

6. A pool structure as claimed in claim 1 wherein said means for drawing water from said pool compartment comprises a pump.

7. A pool structure as claimed in claim 1 wherein said means for drawing water from said pool compartment comprises:

(a) a drain mounted in said enclosure adjacent the bottom of said pool compartment and extending into said equipment compartment;

(b) a pump in said equipment compartment and having an inlet and an outlet with the inlet thereof coupled to said drain; and (c) a filter mounted in said equipment compartment and having an inlet and an outlet, the inlet of said filter coupled to the outlet of said pump and the outlet of said filter coupled to said header.

8. A pool structure as claimed in claim 1 and further comprising:

(a) said enclosure including,

I. a double panel front wall upstanding from said bottom wall,

II. an opposed pair of double panel side walls upstanding from said bottom wall and integral with said front wall, and III. a double panel rear wall upstanding from said bottom wall and integral with said pair of side walls, said double panel rear wall extending above said front and said pair of side walls to form a waterfall superstructure on said enclosure;

(b) a cross pipe water distribution manifold mounted within said double panel rear wall adjacent the upper end thereof and having a plurality of nozzles mounted thereon in substantially evenly spaced increments with those nozzles extending radially therefrom exteriorly of said rear wall above said pool compartment;

(c) pipe means coupling said cross pipe water distribution manifold with said header; and (d) means mounted in said pipe means for allowing optional supplying of water under pressure from said header to said cross pipe water distribution manifold.

* * * * *